US006362845B1

(12) United States Patent
Genovese

(10) Patent No.: US 6,362,845 B1
(45) Date of Patent: Mar. 26, 2002

(54) METHOD AND APPARATUS FOR ELECTROSTATOGRAPHIC PRINTING UTILIZING AN ELECTRODE ARRAY AND A CHARGE RETENTIVE IMAGING MEMBER

(75) Inventor: Frank C. Genovese, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/728,532

(22) Filed: Dec. 1, 2000

(51) Int. Cl.[7] ..... B41J 2/39
(52) U.S. Cl. ..... 347/141; 347/147
(58) Field of Search ..... 347/141–150, 347/153; 101/DIG. 37; 400/118.3

(56) References Cited

U.S. PATENT DOCUMENTS

| | | | | |
|---|---|---|---|---|
| 3,611,419 A | 10/1971 | Blumenthal | ..... | 346/74 ES |
| 4,233,611 A | 11/1980 | Nakano et al. | ..... | 346/155 |
| 4,409,603 A | 10/1983 | Goffe | ..... | 346/155 |
| 4,546,364 A | 10/1985 | Todoh et al. | ..... | 346/155 |
| 5,812,170 A * | 9/1998 | Kuehnle et al. | ..... | 347/151 |

* cited by examiner

*Primary Examiner*—Joan Pendegrass
(74) *Attorney, Agent, or Firm*—Mark Z. Dudley

(57) ABSTRACT

An electrostatic recording medium includes a charge retentive layer located on a conductive substrate. An image recording surface on the charge retentive layer includes an array of discrete, conductive segments present in the image recording surface. A multiple electrode assembly having an array of recording electrode tips may be aligned for engagement with the image recording surface. Relative movement between the recording head and the electrostatic recording medium may be provided in such a manner that certain members of the recording electrode tips momentarily achieve Ohmic contact with respective elements of the discrete conductive segments present in the image recording surface. A latent image may be created in the electrostatic recording medium as the charge retentive layer receives an imagewise pattern of localized, discrete charges according to a variable voltage potential present at the tips of the recording electrode during the respective moments of Ohmic contact. The electrostatic latent image may then be made visible by operation of a developer station.

13 Claims, 5 Drawing Sheets

METHOD AND APPARATUS FOR ELECTROSTATOGRAPHIC PRINTING UTILIZING AN ELECTRODE ARRAY AND A CHARGE RETENTIVE IMAGING MEMBER

This invention relates to electrostatic printing and, more particularly, to a method and apparatus for applying a charge pattern in an image configuration to a charge-retentive imaging member by the utilization of an electrode array.

Electrostatic printing in its simplest form consists of producing charge patterns on a suitable surface by application of an electric field and then rendering the charge patterns visible and fixed by use of a suitable developer material. Some prior art electrostatic printing devices use a recording head, having a plurality of electrodes in what is known as a stylus array, and a recording medium typically in the form of a dielectric coated paper or web. While the recording medium is urged into engagement with the styli electrodes, a sufficient voltage is developed across selected styli and the recording medium to cause selective charging of the recording medium. The electrostatic pattern is then made visible in a suitable developer station by suitable developer materials.

In certain approaches, the stylus array maintains a gap between the electrodes and the recording medium so as to charge an electroreceptor in accordance with digital image information fed to the array. In this regard, the electrodes preferably make no contact with the recording medium; the voltage applied to the electrodes causes electrical breakdown of the air between the styli and the insulating electroreceptor, thereby charging the electroreceptor in accordance with the information applied to the array. Those familiar with electrical gas discharges will appreciate that the applied voltage necessary to initiate air breakdown and generate a plasma-discharge between styli tips and the electroreceptive surface is at a minimum at a stylus spacing of a few microns rather than at closer proximity, as described by a Paschen relationship. Consequently, the electrodes, or portions thereof, must be maintained at a proximate but non-contacting distance from the recording medium in order that a finite air gap be present between the recording medium and the electrodes, thereby permitting a conductive plasma to be generated with minimum applied voltage. Subsequently, the recording medium can be toned in the usual fashion followed by transfer to a suitable substrate, such as paper or the like, in the customary fashion. However, in such non-contact systems, the image resolution suffers because of the spreading of the plasma discharge in contact with the recording medium, and the difficulty in controlling the amount of charge deposited by the electrodes at a given applied voltage. The voltage drop in the plasma depends critically on the electrode spacing, so such systems require close tolerances with regard to the gap between the electrodes and the electroreceptor in order to maintain a constant level of deposited charge on the electroreceptor. Further, since there is an unavoidable voltage drop due to the dynamics of the plasma through which the charging current flows, the resulting potential of an electroreceptor surface charged by this technique is substantially less than the voltage applied to the electrodes.

Other approaches to imagewise charging of a recording medium by a recording head involve direct contact of the electrodes to the recording medium. Some such systems utilize a multi-stylus recording head that is transported in an oscillatory fashion across the recording medium while the electrodes are intended to maintain contact with the surface of the recording medium. In this approach, each electrode engages the recording medium typically under a significant pressure, which causes an undesirable tribocharging of the recording material (even in the absence of an applied voltage to the electrode). In order to counteract the effects of the triboelectric charging of the recording material, a compensating direct current voltage may be applied to the electrode. Also, a fairly high contact pressure is required between each electrode and the recording material to ensure that all the electrodes charge the substrate in a consistent and simultaneous manner. As a result, there is abrasion of the styli and the recording medium and disadvantageous deformation of the recording medium due to the contact pressure of the styli against the recording medium.

Accordingly, in one embodiment of the present invention, there is an improved method and apparatus for selectively charging an electrostatic recording medium, wherein a multiple electrode array recording head includes an array of electrodes having recording electrode tips disposed in a flexible insulating layer. The recording electrode tips are presented in a recording head tip that is sufficiently flexible such that the recording head tip may be aligned against an image recording surface of the electrostatic recording medium, whereupon the distal edge of the insulating layer conforms to the image recording surface and the recording electrode tips are placed in direct contact with the electrostatic recording medium. Relative movement between the recording head and the electrostatic recording medium may be provided in a conventional manner such that an electrostatic latent image may be deposited in the electrostatic recording medium.

In another embodiment of the present invention, there is an improved electrostatic recording medium wherein a charge retentive layer is located on a conductive substrate. An image recording surface on the charge retentive layer includes an array of discrete, conductive segments present in the image recording surface. The improved electrostatic recording medium is useful in contact electrostatic printing, wherein an array of recording electrodes may be operated in direct contact with the conductive segment array, with less surface degradation and without resort to a high contact pressure for the traditional efforts to counteract the effects of triboelectric charging of the recording material.

In another embodiment of the present invention, the multiple electrode array recording head and the electrostatic recording medium may be operated in an improved electrostatic printing apparatus. The electrostatic recording medium is constructed to include a charge retentive layer located on a conductive substrate. An image recording surface on the charge retentive layer includes an array of discrete, conductive segments present in the image recording surface. The electrostatic recording head includes a multiple electrode assembly having recording electrode tips that are aligned for engagement with the image recording surface. Relative movement between the recording head and the electrostatic recording medium may be provided in such a manner that certain members of the recording electrode tips momentarily achieve Ohmic contact with respective elements of the discrete conductive segments present in the image recording surface. The charge retentive layer receives an imagewise pattern of localized, discrete charges according to a varying charging voltage present at the tips of the recording electrodes during the respective moments of Ohmic contact. The Ohmic nature of the contact provides charging of the discrete conductive segments to a potential substantially equal to the voltage of the recording electrode. The resulting electrostatic latent image may then be made visible by operation of a developer station by use of suitable developer materials.

The present invention will be better understood from the following description of specific embodiments and the drawing figures (which are not necessarily to scale) wherein.

Figure 1:
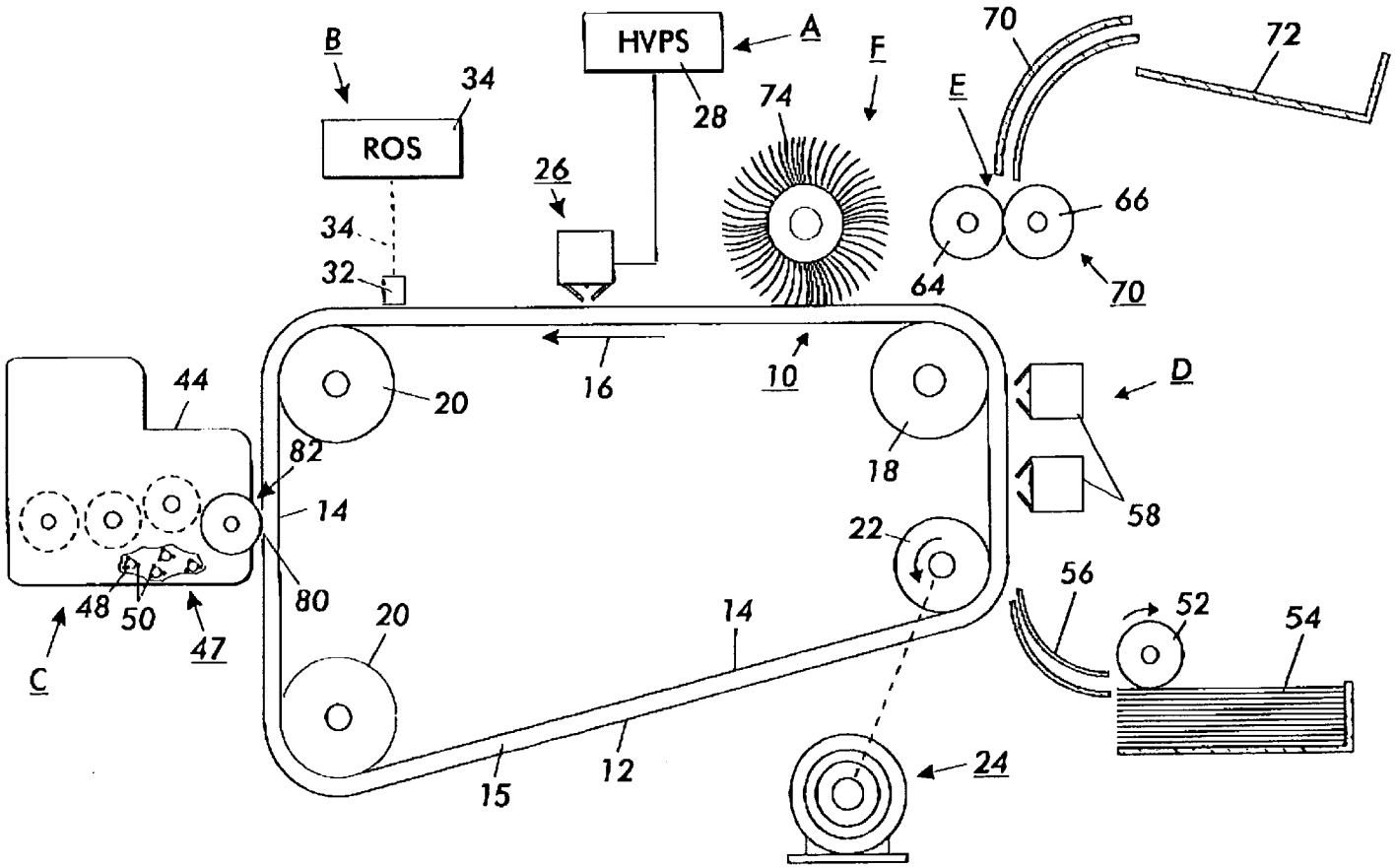
FIG. 1 is a simplified schematic elevational view of an illustrative electrostatographic printing apparatus which incorporates a novel recording head and novel recording medium constructed according to the present invention.

A detailed description of the exemplary embodiments may now be understood with reference to the Figures. Although the present invention will now be described in connection with one or more embodiments, such description is not intended to be so limited. On the contrary, it is intended to cover all alternatives, modifications, and equivalents as may be included within the spirit and scope of the invention as defined by the appended claims. In the following description, usage of like reference numerals will designate identical elements.

FIG. 1 is a schematic elevational view of an illustrative contact electrostatic printing apparatus 100 which incorporates a novel recording head and novel recording medium constructed according to the present invention.

Although the recording head and recording medium of the present invention are particularly well adapted for use in the illustrative printing apparatus, it will become evident that the embodiment of such are equally well suited for use in other printing machines and other applications of selective electrostatographic charging; as such, application of the present invention need not be limited to the illustrated embodiments.

A preferred embodiment of the novel recording medium is provided in the form of an electroreceptor belt 10 that includes an image recording surface 12, a conductive substrate 14, and a charge retentive layer 15. (Although the electrophotographic printing apparatus 100 employs an electroreceptor belt 10, an electroreceptor constructed in the form of a drum is also contemplated, and may be substituted therefor.) The electroreceptor belt 10 is driven by means of motor 24 along a path defined by rollers 18, 20 and 22, the direction of movement being counter-clockwise as viewed and as shown by arrow 16. A high voltage power supply 28 is coupled to corona generator 26. Depending upon the process chosen for establishing the desired latent electrostatic image, a portion of the electroreceptor belt 10 passes through a charge station A at which a corona generator 26 may be operated to prepare surface 12 to a predetermined, substantially uniform, electrical potential.

Next, the prepared portion of the surface 12 is advanced through an image recording station B. At image recording station B, a preferred embodiment of novel image recording head 32 lays out the image in an imagewise electrostatic pattern having a predetermined number of pixels per inch. To do so, the image recording station B selectively alters the prepared image recording surface 12 according to an imagewise pattern provided by way of a image signal on cable 36 from an image recording unit 34 so as to create the desired latent electrostatic image. For example, preparation of the image recording surface 12 may include application of a uniformly distributed charge, whereupon the recording station B may be operated to selectively increase or decrease the uniformly distributed charge. For example, in certain applications, the resulting latent image may comprise an imagewise pattern of charged picture elements (pixels), each having a respectively elevated charge potential, which are selectively distributed among a background having a substantially reduced or insignificant charge potential.

After the electrostatic latent image has been recorded on the image recording surface 12, the motion of the electroreceptor belt 10 advances the latent image to development station C. A development system 38 develops the latent image recorded on the image recording surface 12. The developer housing 44 stores a supply of developer material 47 which, for example, may be a two component developer material of at least magnetic carrier granules 48 having toner particles 50 adhering triboelectrically thereto. It should be appreciated that the developer material may likewise comprise a one-component developer material consisting primarily of toner particles. Preferably, the development system 38 is a hybrid scavangeless development system. In a non-scavenging development system, toner is detached from a donor roll 80 by applying AC electric field to self-spaced electrode structures (not shown), commonly in the form of wires positioned in the nip between the surface 82 of donor roll 80 and the photoreceptor electroreceptor belt 10 in the case of hybrid non-scavenging development, or by applying the AC electrical field directly to the donor roll 80 in the case of hybrid jumping development. This forms a toner powder cloud in the nip and, in the example of a selective distribution of charges in the latent image, the latent image attracts toner particles 50 from the powder cloud.

After the electrostatic latent image has been developed, the motion of the electroreceptor belt 10 advances the developed image to transfer station D, at which a copy sheet 54 is advanced by roll 52 and guides 56 into contact with the developed image on electroreceptor belt 10. A corona generator 58 is used to deposit ions on the back of the sheet so as to attract the toner image from electroreceptor belt 10 to the sheet. As the belt turns around roller 18, the sheet is stripped therefrom with the toner image thereon.

From transfer station D the sheet is advanced by a conveyor (not shown) to fusing station E which includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the system by the operator.

After the sheet is separated from the image recording surface 12 of electroreceptor belt 10, the residual developer material adhering to the image recording surface 12 is removed at a cleaning station F by a rotatably mounted brush 74 in contact with the image recording surface 12. Subsequent to cleaning, a charge station A may be operated to discharge the image recording surface 12 to dissipate any residual electrostatic charge remaining thereon and reestablish the image recording surface 12 at a predetermined, substantially uniform, electrical potential prior to the next successive imaging cycle.

Figure 2:
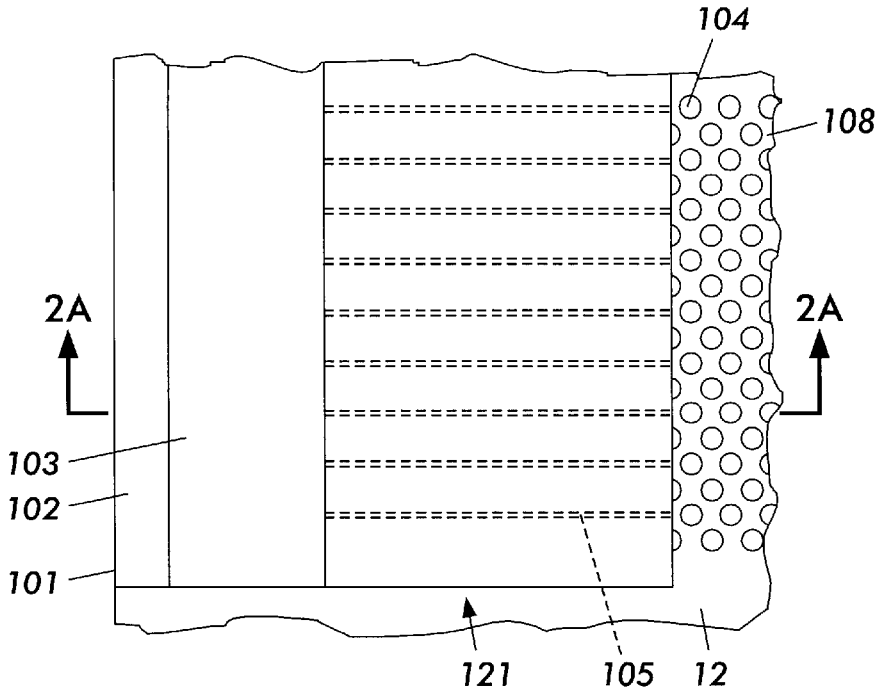
FIG. 2 is a plan view.
Figure 2A:
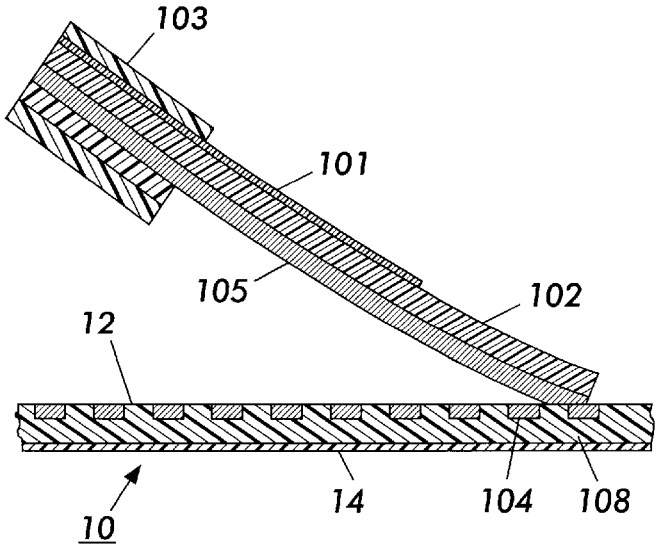
FIG. 2A is a side sectional view, respectively, of a segment of the recording head operating in contact with the recording medium, suitable for operation in the apparatus of FIG. 1.

FIG. 2 is a plan view, and FIG. 2A is a side sectional view, respectively, of a segment of the novel recording head 32 in operation, i.e., in contact with the image recording surface 12 of the electroreceptor belt 10, as may be constructed and operated according to the present invention for inclusion in, for example, the recording station B.

The recording head 32 includes a planar base 101 made of a thin plate of rigid substrate material; an electrically insulating layer 102 made of a flexible insulating material such as, e.g., a polyimide resin, or the like. The insulating layer 102 is formed on one surface of the base 101 and is also extensive therefrom. A driving integrated circuit (IC) 103 is fixed on the insulating layer 102 and may be operated to supply, via suitable electrical connections (not shown), a selectively variable (i.e., in imagewise fashion) electrical voltage to each member of the array of conductive strips that form the array of recording electrodes 105. The applied voltage is responsive to digital image input signals received on the cable 36.

The recording electrodes 105 are arranged in a predetermined, closely-spaced array according to known techniques to achieve optimum density yet minimal crosstalk. Each recording electrode 105 is formed of a strip of conductive material of a predetermined length that is preferably provided in the insulating layer 102 by, for example, photoetching or plating. Alternatively, the recording electrodes 105 may be formed by isolated filaments of flexible conductive polymeric resin, or bundles of conductive (pultruded) carbon fibers in insulating layer 102. Upon suitable finishing of the recording head tip 121, a linear array of voltage potential applicators constructed in the form of recording electrode tips 106 are disposed in a row at the distal edge of the insulating layer 102. Thus, the insulating layer 102 encapsulates the majority of the length of the array of recording electrodes 105 except for the requisite connections of the recording electrodes 105 to the integrated circuit 103 and the recording electrode tips 106. One suitable construction technique includes, for example, photoetching and vapor-deposition of a nickel layer on the entire area of the insulating layer 102, coating the layer with a photoresist, exposing the layer to UV radiation through a photo mask, removing the photoresist, and etching the nickel layer in the unexposed area.

The insulating layer 102 may be composed of an insulating film having a thickness in the range of 10 to 250 $\mu$m. The recording electrodes 105 are arranged in generally parallel fashion such that the recording electrode tips 106 exhibit a density in the range of, for example, 5 to 50 recording electrode tips/mm; each recording electrode 105 has a width in the range of, for example, 20 to 200 $\mu$m, and 2 to 50 $\mu$m in thickness. The recording electrode tips 106 have a diameter in the range of, for example, 20 to 200 $\mu$m.

Turning now to the construction of the electroreceptor belt 10, embedded in the image recording surface 12 is a dense array of electrically conductive segments 104. Each of the conductive segments 104 is a discrete portion of conductive material having a shallow depth and an exposed, outwardly facing surface. The conductive segments 104 may be densely arranged in either a random pattern, or, preferably, in a regular pattern similar to that of, for example, a hexagonal packed array, or a rotated halftone screen. Preferably, the spacing of the conductive segments 104 generally corresponds to the spacing of the recording electrode tips 106. Increasing the density of both the recording electrode tips 106 and the conductive segments 104 will increase the resolution of the latent image to be recorded in the recording medium.

In the illustrated embodiment, the conductive segments 104 exhibit an overall density in the range of 25 to 5000 segments/mm$^2$ and measure about 10 to 200 $\mu$m in diameter and 0.5 to 50 $\mu$m in thickness. Although the outwardly facing surfaces of the conductive segments 104 are, merely for example, illustrated as uniformly-spaced, circular disks, other embodiment of the conductive segments may be constructed according to the present invention in other shapes or in other geometries, such as rectilinear, hexagonal, ellipsoidal, or even irregular shapes having a variable distribution of sizes.

The charge retentive layer 15 of FIG. 1 is preferably provided in the form of a layer 108 of dielectric material of generally uniform thickness, of approximately 0.5 to 100 $\mu$m thick, formed on the conductive substrate 14. Suitable dielectric materials are known in the art.

As illustrated, at least a portion of the recording head tip 121 is sufficiently flexible such that the recording head tip 121 may be aligned transversely with the electroreceptor belt 10 and applied, with slight pressure, to the image recording surface 12, whereupon the distal edge of the insulating layer 102 conforms to the image recording surface 12. Each recording electrode tip 106 is then positioned to slidably engage, and therefore momentarily contact, any one of the conductive segments 104 in the image recording surface 12 that is immediately contiguous to the recording electrode tip 106 as the relative movement occurs between the recording head 32 and the image recording surface 12.

Figure 3:
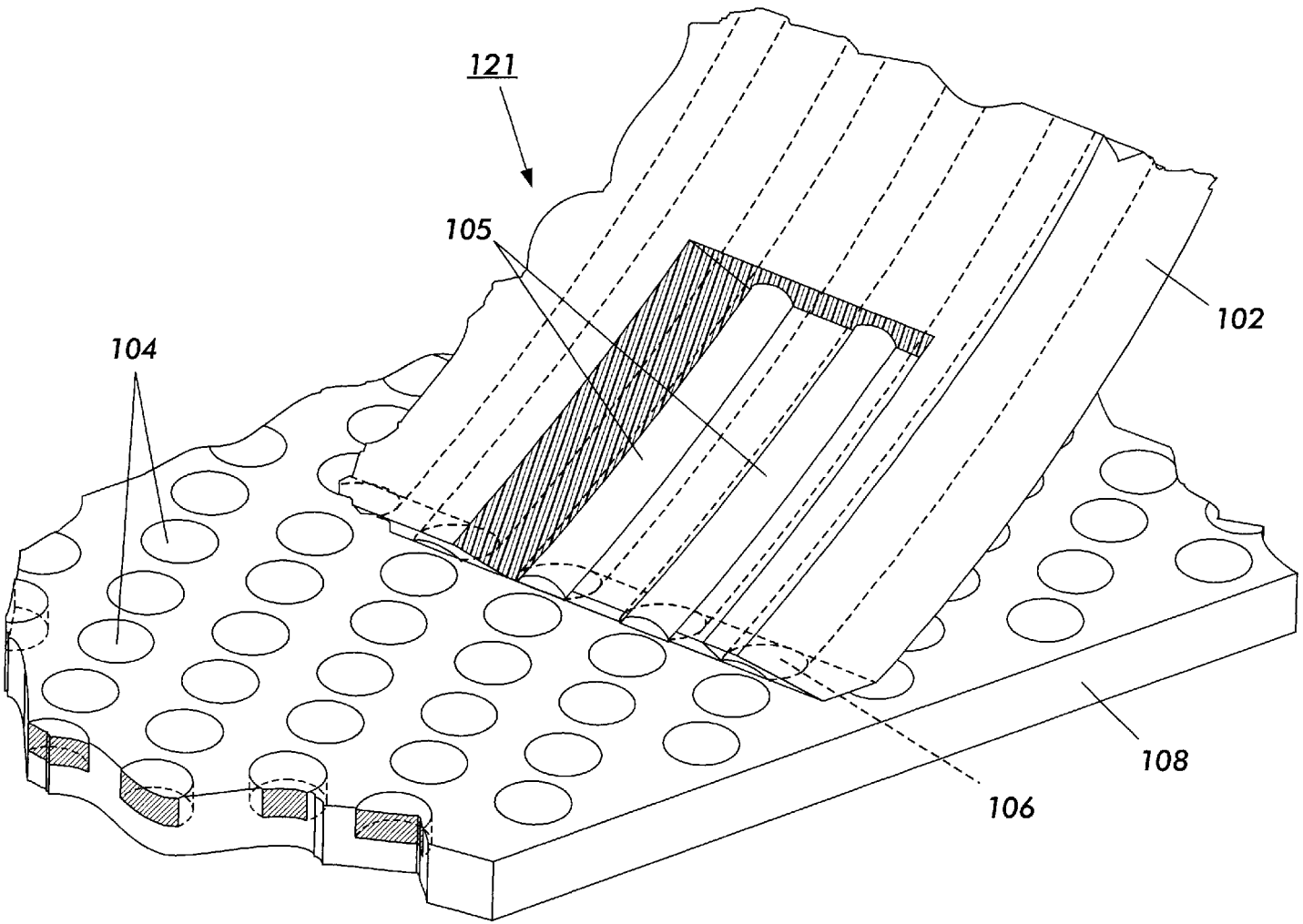
FIG. 3 is a side perspective view of the tip of the recording head of FIGS. 2 and 2A, having a portion thereof cut away for clarity.

The recording head tip 121 thus superimposes the members of the recording electrode tips 106 onto respective elements of the conductive segments 104 when aligned against the image recording surface 12 of the electroreceptor belt 10, as shown in FIGS. 2A and 3. Because of the flexibility of the insulating layer 102, the recording head tip 121 need only to slightly conform to the image recording surface 12 in order to allow the array of conductive recording electrode tips 106 to establish sufficient Ohmic contact with any exposed part of respective ones of the electrically isolated conductive segments 104. Relative movement of the recording head 32 and the electroreceptor belt 10 thus causes the recording head tip 121 to maintain contact with the image recording surface 12 using a predetermined, optimal pressure that minimizes damage to the image recording surface 12 and the recording head 32.

The image recording surface 12 is thus useful as the operable surface of a recording medium that exhibits a plurality of discrete, charge-retentive pixel areas, each of which corresponds to at least one respective conductive segment 104. That is, each charge-retentive pixel area includes at least one of the conductive segments 104, a portion of the conductive substrate 14 that underlies the particular conductive segment 104, and the portion of the dielectric layer 108 that lies between the conductive segment 104 and the respective portion of the conductive substrate 14. Alternatively, each charge-retentive pixel may include a group of several conductive segments 104, that section of the conductive substrate 14 that underlies the group of several conductive segments 104, and those portions of the dielectric layer 108 that lie between the group of conductive segments 104 and the respectively underlying portion of the conductive substrate 14. The result is a dense, two-dimensional array of charge-retentive pixel areas. Each charge-retentive pixel area is responsive to the creation or dissipation of an electrostatic charge according to the selective application of a voltage potential as provided by the recording head 32.

The recording electrodes 105 in the recording head 32 are driven by a suitable drive circuit 103 that in turn is controlled by an image recording unit 34. The control unit 20 is connected to, and operates with, appropriate image information interface electronics (not shown) that receive an image and generate a suitable image recording signal, as well as the output from other control signal electronics. The image recording signal is converted into a digital signal that is fed to the cable 36. The image recording unit 34 may be understood to include a controller, program storage devices, and interface electronics necessary for driving the drive circuit 103, according a predetermined sequence, and for causing the distribution of voltages among the recording electrodes 105 on the recording head 32 in response to the image recording signal. The image recording unit 34 may be operable within a larger electronics section that includes a central processing unit (not shown), or may be provided as a separate unit.

Figure 4:
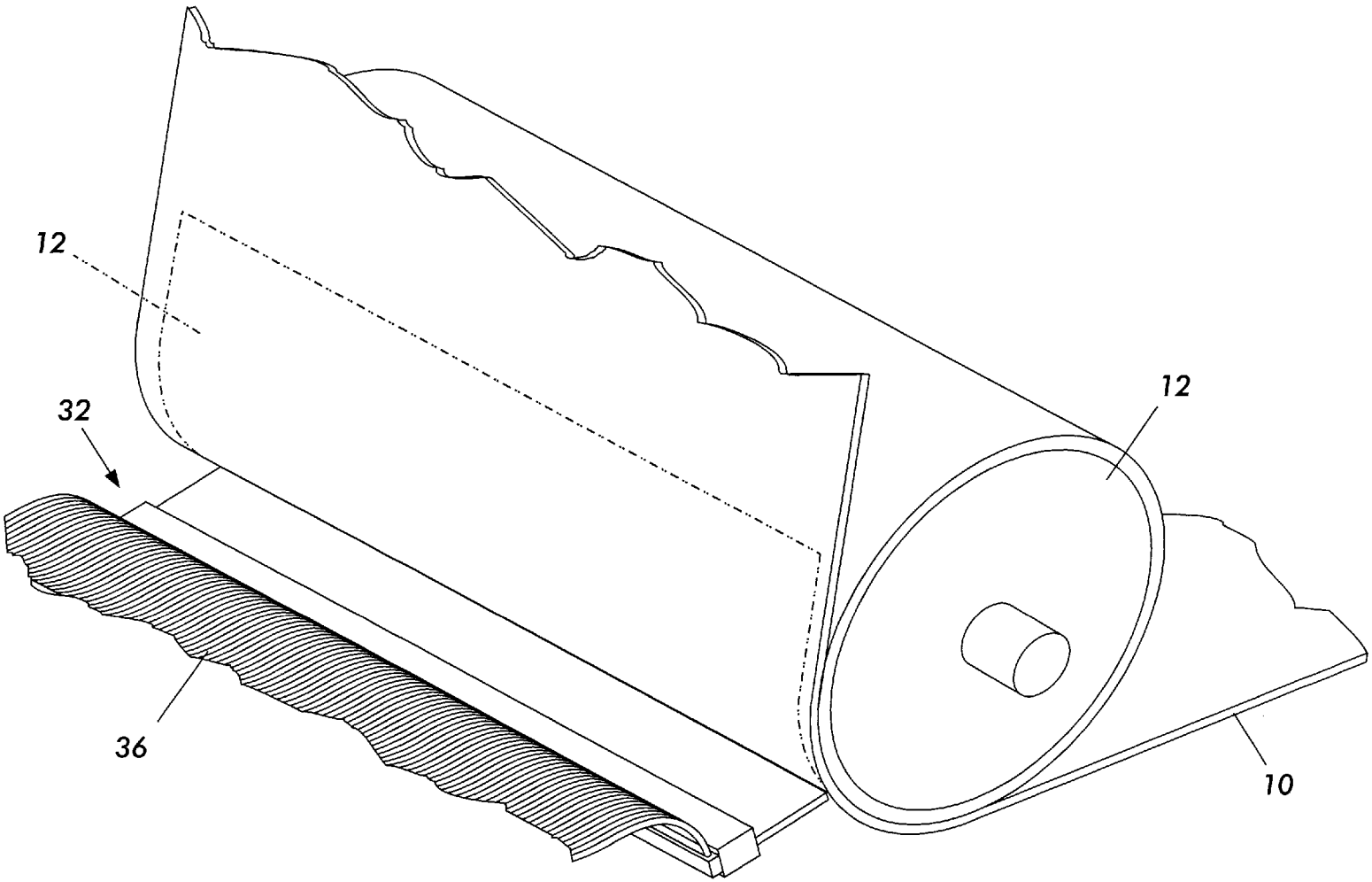
FIG. 4 is a side perspective view of a single recording head in operation in the apparatus of FIG. 1.

FIG. 4 is a side perspective view of the recording head 32 in operation while recording an electrostatic latent image 38 on the image recording surface 12, according to the operation of in the electrostatographic apparatus 100 of FIG. 1.

Figure 5:
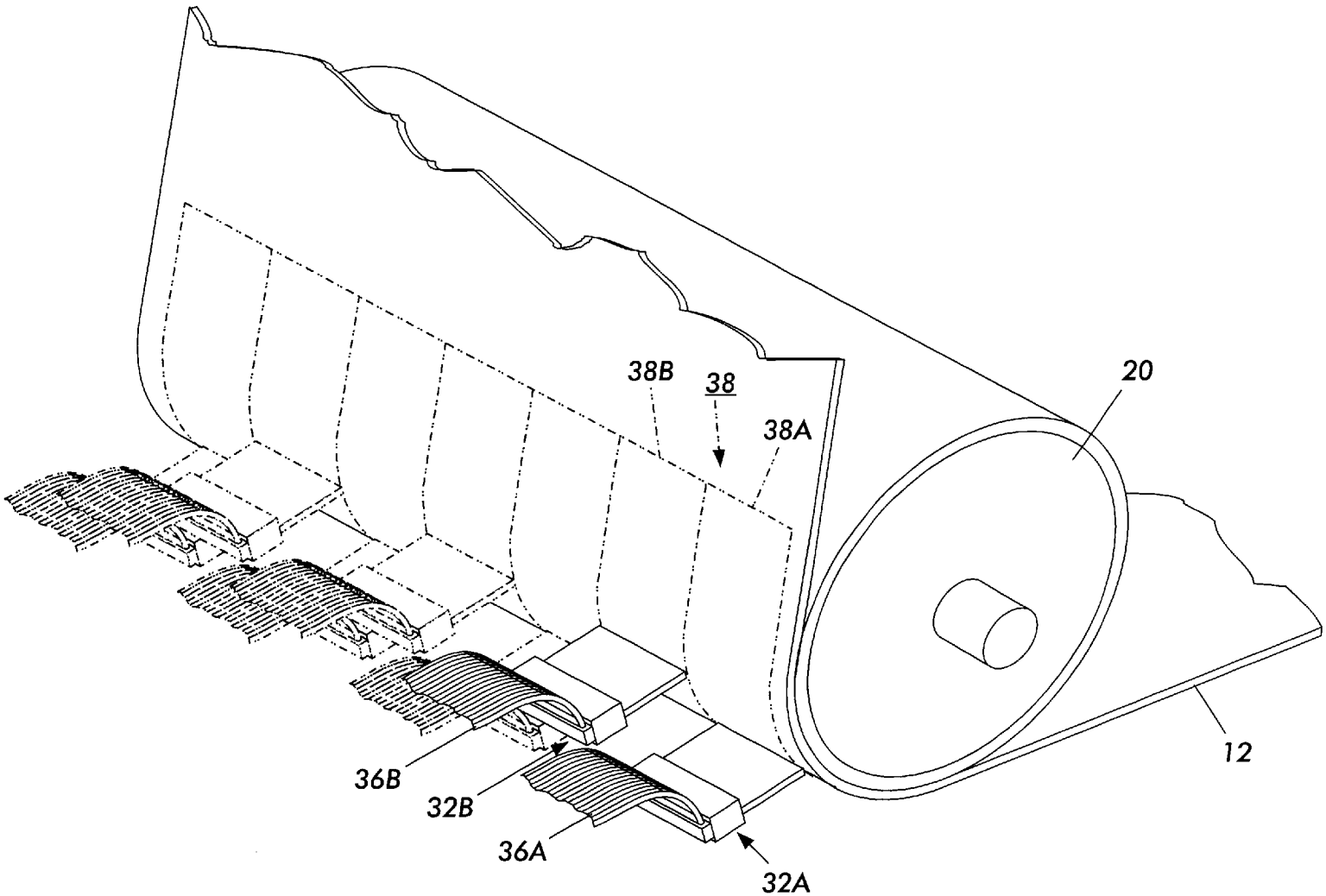
FIG. 5 is a side perspective view of a plurality of recording heads in operation in an alternative embodiment of the apparatus of FIG. 1.

FIG. 5 shows a side perspective view of an alternative embodiment of the electrostatographic apparatus of FIG. 1, wherein a multiplicity of recording heads 32A, 32B, each of which are operable singly or in parallel, are useful for recording respective strip-wise portions 38A, 38B of the desired electrostatic latent image 38 on the image recording surface 12. In the illustrative embodiment, the portions 38A, 38B are contiguous and parallel; however, other arrangements are also contemplated. Still other embodiments of present invention include other arrangements of multiple recording heads 32A, 32B. For example, a plurality of the recording heads 32 may be mounted with their respective recording head tips at an angle other than 90 degrees to the direction of relative motion between the recording heads 32 and the electroreceptor belt 10. Hence, a plurality of recording heads 32 may be arranged in, for example, coplanar, stacked, staggered, or overlapping configurations.

The disclosed embodiments may be operated and controlled by appropriate operation of conventional control systems. It is well known and preferable to program and execute control functions, e.g., imaging, printing, paper handling, and other such functions in logic-based control systems, e.g., "controllers", such as with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system(s) or method(s) may be implemented partially or fully in a networked, embedded, or other ancillary controller, or in firmware, and by using standard logic circuits, programmable arrays, or single chip VLSI designs.

The terms "reprographic" or "reproduction" apparatus, "printing" or "printer", as used herein, broadly encompasses various printers, copiers or multifunction machines or systems, electrographic and electrostatographic or otherwise, unless otherwise defined in a claim. The term "sheet" herein refers to a generally planar segment of paper, plastic, or other suitable physical substrate amenable to receiving a developed image, whether precut or web fed. A "copy sheet" may be abbreviated as a "copy" or called a "hardcopy".

As to specific components of the subject apparatus or methods, or alternatives therefor, it will be appreciated that such components are optional if so designated, and if such components are known per se in other apparatus or applications, other versions may be additionally or alternatively used, especially those from art cited herein. All references cited in this specification, and their references, are incorporated by reference herein where appropriate for teachings of additional or alternative details, features, and/or technical background.

What is claimed is:

1. An electrostatic printing apparatus for printing an image on a copy substrate, comprising:

a recording medium having: a conductive substrate, an image recording surface having therein an array of discrete, conductive segments, and a charge retentive layer disposed between the conductive substrate and the image recording surface, the recording medium thereby having a respective array of charge-retentive pixel areas;

a recording head including an array of recording electrodes having recording electrode tips in contact with the image recording surface of the recording medium and a flexible insulator layer for supporting and uniformly spacing the recording electrode tips in the electrode array;

means for effecting relative movement of the electrode array and the recording medium in such a manner that at least one of the recording electrode tips momentarily achieves Ohmic contact with a corresponding one of the discrete conductive segments present in the image recording surface;

means for selectively energizing the recording electrode tip so as to provide an imagewise distribution of electrostatic charges to the array of pixel areas, thereby establishing an electrostatic latent image;

a developer station for developing the electrostatic latent image formed on the recording medium; and a transfer station for transferring the developed electrostatic latent image to the copy substrate.

2. The apparatus of claim 1, wherein the recording electrode tips are disposed in a linear array having a density in the range of about 5 to 50 recording electrode tips per millimeter.

3. The apparatus of claim 1, wherein the conductive segments exhibit an overall density in the range of 25 to 5000 conductive segments per millimeter$^2$ .

4. The apparatus of claim 1, wherein the spacing of the conductive segments is less than the spacing of the recording electrode tips.

5. The apparatus of claim 1, wherein the recording medium further comprises an electroreceptor belt.

6. The apparatus of claim 5, wherein the recording head further comprises a recording head tip aligned transversely with the relative motion of the recording medium and the recording head.

7. The apparatus of claim 6, wherein at least a portion of the distal edge of the recording head tip is conformable to the image recording surface.

8. The apparatus of claim 1, wherein the recording head is operable to provide a respective first portion of the latent image, and further comprising a second recording head having a second recording head tip applied to the image recording surface, the second recording head being operable to provide a respective second portion of the latent image.

9. The apparatus of claim 8, wherein the plurality of the recording heads is arranged in at least one of the following configurations: coplanar, staggered, and overlapping.

10. The apparatus of claim 1, wherein the conductive segments further comprise respective outwardly facing surfaces provided in ellipsoidal shape.

11. The apparatus of claim 1, wherein the conductive segments in the conductive segment array are uniformly spaced.

12. An electrostatic recording head for selectively charging an image recording surface in an electrostatic recording medium, comprising:

a multiple electrode array recording head that includes an array of recording electrodes disposed in an insulating layer for supporting and uniformly spacing the recording electrode tips in the electrode array and having a respective array of exposed recording electrode tips arranged in a recording head tip, wherein the recording head tip may be aligned against the image recording surface, whereupon at least a portion of the distal edge of the recording head tip conforms to the image recording surface and at least a portion of the array of recording electrode tips are placed in Ohmic contact with the image recording surface of the electrostatic recording medium.

13. A method of contact electrostatic printing, comprising the steps of:

providing an electrostatic recording medium, including a conductive substrate, a charge retentive layer located on the conductive substrate, and an image recording surface or the charge retentive layer having an array of discrete, conductive segments present in the image recording surface, each segment having a respective exposed surface;

providing an electrostatic recording head having an array of recording electrode tips and a flexible insulator layer for supporting and uniformly spacing the recording electrode tips in the electrode array;

aligning the recording electrode tips for engagement with the image recording surface;

providing relative movement between the recording electrode tips and the electrostatic recording medium in such a manner that at least one of the recording electrode tips momentarily achieves Ohmic contact with a plurality of the surfaces of the discrete conductive segments;

creating a latent electrostatic image in the electrostatic recording medium by effecting selective application of a voltage potential during such moments of Ohmic contact; and developing the electrostatic latent image.

* * * * *